US007737905B1

(12) United States Patent
Meloling et al.

(10) Patent No.: US 7,737,905 B1
(45) Date of Patent: Jun. 15, 2010

(54) BROADBAND FERRITE LOADED LOOP ANTENNA

(75) Inventors: John Harold Meloling, San Diego, CA (US); David Carlos Dawson, Lemon Grove, CA (US); Peder Meyer Hansen, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 183 days.

(21) Appl. No.: 12/200,425

(22) Filed: Aug. 28, 2008

(51) Int. Cl.
*H01Q 7/08* (2006.01)
*H01Q 1/00* (2006.01)

(52) U.S. Cl. ..... 343/788; 343/787

(58) Field of Classification Search ..... 343/787, 343/788

See application file for complete search history.

(56) References Cited

U.S. PATENT DOCUMENTS 4,376,941 A 3/1983 Zenel
4,774,519 A 9/1988 Pease et al.
4,805,232 A * 2/1989 Ma ..... 455/291
4,978,966 A 12/1990 Takizawa et al.
5,517,202 A 5/1996 Patel et al.
5,561,438 A * 10/1996 Nakazawa et al. ..... 343/787
5,933,117 A 8/1999 Gerhard

* cited by examiner

*Primary Examiner*—Hoang V Nguyen
(74) *Attorney, Agent, or Firm*—Kyle Eppele; J. Eric Anderson

(57) ABSTRACT

A ferrite-loaded broadband loop antenna having nearly comparable transmit/receive characteristics is disclosed. The antenna contains a low loss ferrite core having a width-to-height ratio of approximately 24 and a depth-to-height ratio of approximately 6, and an antenna feed plate assembly centered about the long axis of the ferrite core, having a width-to-height ratio of approximately 6 and a width-to-depth ratio of approximately 1, and a balanced feed located at the center of the antenna feed plate assembly, positioned on the radiating side of the antenna, and a low loss center element in the ferrite core, the center element having at least one of a loss tangent and a permeability that is lower than the ferrite core, and a grounding surface coupled to the antenna feed plates.

20 Claims, 9 Drawing Sheets

Center fed loop antenna with ferrite core

Center fed loop antenna with evacuated ferrite core

70

BROADBAND FERRITE LOADED LOOP ANTENNA

FEDERALLY SPONSORED RESEARCH AND DEVELOPMENT

This invention (Navy Case No. 099023) is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice 619-553-2778; email T2@spawar.navy.mil.

BACKGROUND

I. Field

This disclosure is related to antennas. More particularly, this disclosure is related to ferrite loaded loop antennas.

II. Background

It is understood in the art that electrically small antennas, such as the loop antenna are inherently inefficient. However, due to their reduced size, antenna designers have expended a significant amount of effort in studying the loop antenna. A loop antenna can be formed from a wire shaped in the form of a loop. From Faraday's law, magnetic fields that "cut" through the plane of the loop will induce a voltage in the loop, thus enabling the loop to act as a receiving antenna. If a current is forced into one end of the loop, then electromagnetic fields from the current will radiate from the plane of the loop and the loop can be operated as a transmitting antenna.

Practitioners, having recognized the reduced size of a loop antenna as compared to a dipole or monopole antenna, have attempted to increase the sensitivity or gain of the loop antenna by replacing the air core of the loop antenna with a ferrite core. The ferrite core aids in concentrating magnetic fields through the loop rather than outside the loop, thus increasing the voltage in the loop antenna. However, the addition of ferrite to increase the magnetic flux in the loop has drawbacks. In the transmit mode, due to heating effects of the ferrite core, the transmitting capabilities of the loop antenna is significantly compromised. Thus, the use of ferrite loaded antennas have not progressed much more beyond anything other than as a receive antenna.

In this disclosure, a ferrite loaded loop antenna is configured in such a manner that the transmit capabilities and frequency response capabilities are enhanced while still preserving general broadband characteristics.

SUMMARY

The foregoing needs are met, to a great extent, by the present disclosure, wherein systems are provided that in some embodiments facilitate a broadband ferrite-loaded loop antenna, comprising a low loss ferrite core having a width-to-height ratio of approximately 24 and a depth-to-height ratio of approximately 6; an antenna feed plate assembly centered about a long axis of the ferrite core, having a width-to-height ratio of approximately 6 and a width-to-depth ratio of approximately 1; a balanced feed located at a center of the antenna feed plate assembly, positioned on a radiating side of the antenna; a low loss center element in the ferrite core, the center element having at least one of a loss tangent and a permeability that is lower than the ferrite core; and a grounding surface coupled to the antenna feed plates, wherein the broadband ferrite-loaded loop antenna operates within a range of approximately 2-30 MHz and has a comparable receiving versus transmitting performance characteristic.

In accordance with another aspect of the present disclosure, a broadband ferrite-loaded loop antenna is provided, comprising means for channeling magnetic fields with a low loss tangent, the channeling means having a width-to-height ratio of approximately 24 and a depth-to-height ratio of approximately 6; means for conducting electrical energy, the conducting means centered about a long axis of the channeling means, and having a width-to-height ratio of approximately 6 and a width-to-depth ratio of approximately 1; means for transitioning electrical energy, the transitioning means being located at a center of the conducting means, and positioned on a radiating side of the antenna; means for reducing losses in the channeling means, the reducing losses means having at least one of a loss tangent and a permeability that is lower than the channeling means; and grounding means coupled to the conducting means, wherein the broadband ferrite-loaded loop antenna operates within a range of approximately 2-30 MHz and has a comparable receiving versus transmitting performance characteristic.

In accordance with yet another aspect of the present disclosure, a method for constructing a broadband ferrite-loaded loop antenna is provided, comprising forming a low loss ferrite core having a width-to-height ratio of approximately 24 and a depth-to-height ratio of approximately 6; attaching an antenna feed plate assembly to the ferrite core about a major axis of the ferrite core, the antenna feed plate assembly centered about a long axis of the ferrite core, having a width-to-height ratio of approximately 6 and a width-to-depth ratio of approximately 1; forming a balanced feed located at a center of the antenna feed plate assembly, positioned on a radiating side of the antenna; forming a low loss center element in the ferrite core, the center element having at least one of a loss tangent and a permeability that is lower than the ferrite core; and attaching a grounding surface coupled to the antenna feed plate assembly, wherein the broadband ferrite-loaded loop antenna operates within a range of approximately 2-30 MHz and has a comparable receiving versus transmitting performance characteristic.

BRIEF DESCRIPTION OF THE DRAWINGS

The features and nature of the present disclosure will become more apparent from the detailed description set forth below when taken in conjunction with the accompanying drawings in which reference characters identify corresponding items.

DETAILED DESCRIPTION

Figure 1:
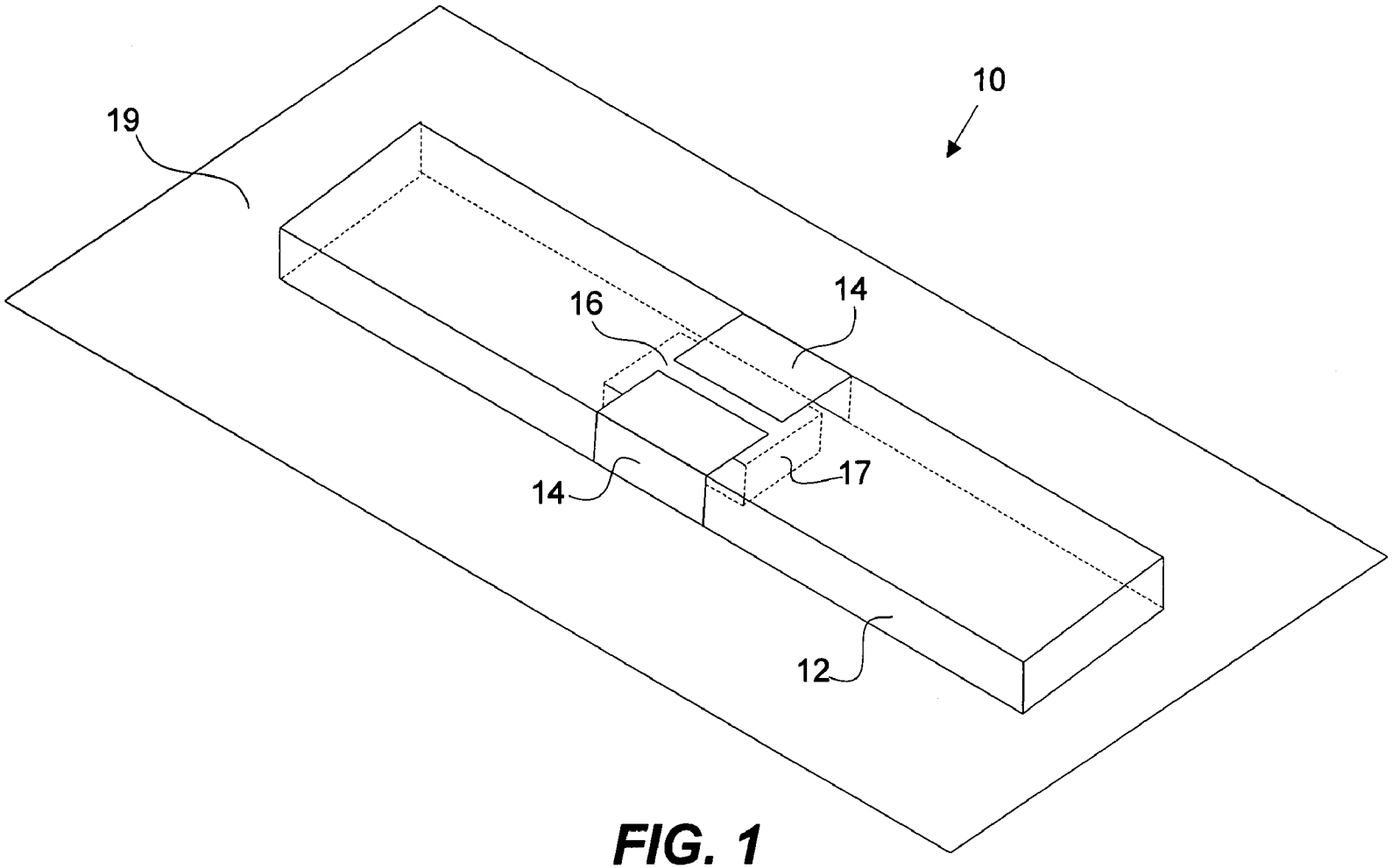
FIG. 1 is an illustration of an exemplary ferrite loaded loop antenna.

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

The exemplary broadband ferrite loaded loop transmit/receive antenna is an improvement over prior art designs in that, for the dimensions demonstrated herein, the lowest and highest wavelengths are in the order 150 and 10 meters, respectively. For this wavelength range, the length of the ferrite core is approximately 2.5 meters, and the length of the feed plates, where the current is concentrated, is approximately half a meter.

The exemplary antenna has been demonstrated to be broadband both in its receive and transmit characteristics and has been found to operate within the range of 2-30 MHz without resonances. The overall "compact" size of the exemplary antenna is in the order of approximately 96 inches long, by 24 inches wide, by 4 inches tall. These dimensions generate an antenna having an overall width-to-height ratio of approximately 24 and a depth-to-height ratio of approximately 6.

The exemplary antenna has also demonstrated a low(er) loss and higher efficiency (2-7 MHz) than standard same-sized loop antennas. Due to these and other aspects detailed below, the exemplary antenna is well suited for use in a recessed cavity, thus enabling the exemplary antenna to be mounted "inside" a surface.

FIG. 1 is an illustration of an exemplary ferrite loaded loop antenna 10. The antenna 10 is illustrated with a ferrite core 12, antenna feed plates 14, balanced feed 16, center element 17, and ground plane 19. The ferrite core 12 is a high performance ferrite compound, a non-limiting example of which is the Type 2 ferrite; and is chosen for its low loss tangent in the lower frequency range as well as for its permeability. The dimensions of the ferrite core 12 are, approximately speaking, 96 inches wide, 24 inches deep, and 4 inches tall. The feed plates 14 are, approximately speaking, 24 inches wide, span the depth of the ferrite core 12, and is 4 inches tall. The dimensions of the antenna feed plates 14 form a width-to-height ratio of approximately 6 and a width-to-depth ratio of approximately 1.

Figure 2:
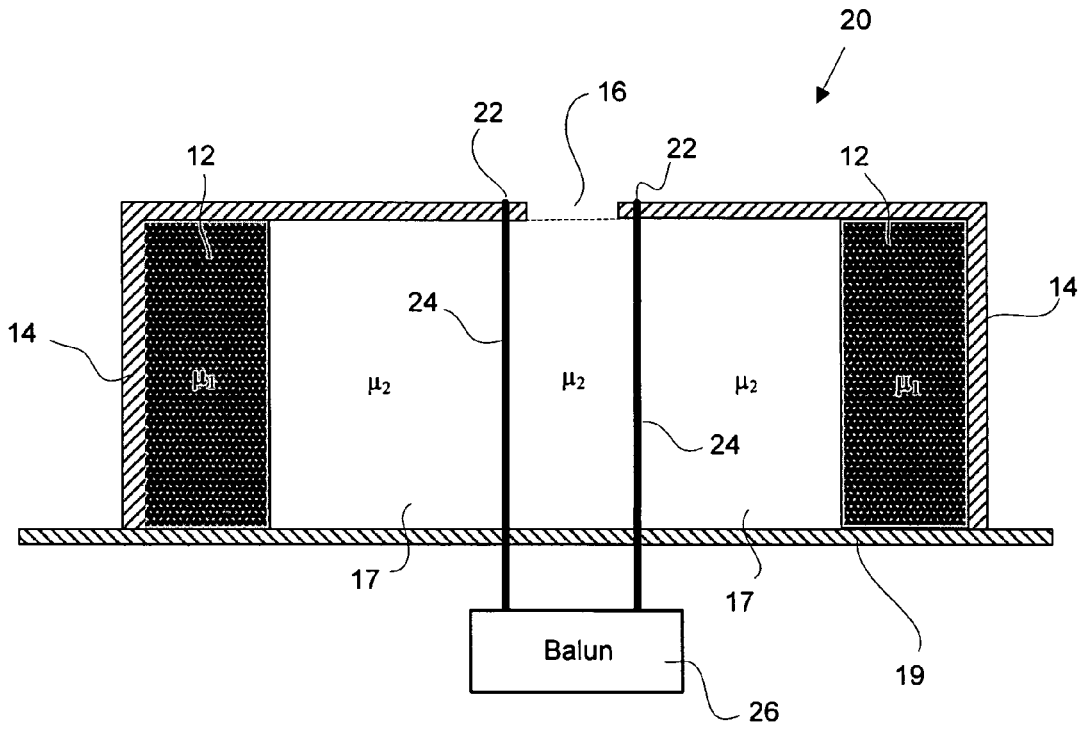
FIG. 2 is a cross-sectional view of an exemplary feed structure.

The balanced feed 16 is generated by forming a gap in the antenna feed plates 14 across the "top" surface spanning the ferrite core 12 and connecting opposing sides of the feed plate gap to conductors that are coupled to a balun (FIG. 2). The gap across the antenna feed plates 14 is approximately 1 inch wide.

The center of the ferrite core 12 is shown with a center element 17 which, in certain embodiments, is a Styrofoam core. The center element 17 can also be nothing other than an evacuation of the ferrite core 12 material in the region near the feed plates 14, which then provides a non-ferrite region (i.e., no ferrite-related losses) around the feed plates 14. The dimensions for the center element 17 in some embodiments are, approximately speaking, 18 inches wide, 9 inches deep, and 4 inches tall. This translates to a width-to-depth ratio of approximately 2 and a depth-to-height ratio of approximately 9/4. The evacuation of the material for certain embodiments when in accordance to the dimensions described, provides sufficient ferrite material in the center of the core to channel fields, while removing sufficient ferrite material to reduce heating effects.

In certain embodiments, the center element 17 can be material with low or negligible losses. Styrofoam material was used as it is inexpensive and it provides structural support for the feed plates 14 as well as support for the feed lines (FIG. 2). Of course, other center element 17 materials besides Styrofoam may be used, according to design preference.

It is noted in FIG. 1 that the balanced feed 16 is located at the "top" of the exemplary antenna 10. Generally, loop antennas are usually fed on the side. However, it was found that a side fed antenna produced undesirable resonances. Therefore, to avoid these resonances, the feed point/balanced feed 16 was moved to the top/center. Another benefit of moving the feed to the top/center and using the center element 17 is that it prevents the ferrite core 12 from experiencing potential high temperature degradation. As is known in the art, the received energy for an antenna at the feed point can be several orders of magnitude lower than the transmitted energy at the feed point. Therefore, by use of the center element 17 and a top oriented balanced feed 16, heating of the ferrite core 12 can be minimized, resulting in better performance characteristics. It should be understood that the terms "top" refers to the radiation broadside orientation of the exemplary antenna 10, and term "center" is understood within the context described.

The antenna feed plates 14 are connected to the ground plane 19 which is "under" the exemplary antenna 10. In some embodiments, the ground plane 19 may be an arbitrary grounding surface, or a mesh or semi-solid material at a reduced potential. In some embodiments, the ground plane 19 may be formed as a cavity to enable the exemplary antenna 10 to be "fitted" into the cavity. Therefore, based on the performance requirements, the exemplary antenna 10 may be placed on or within the surface of a vehicle or ship, without significantly increasing the profile of the vehicle or ship.

While FIG. 1 illustrates an exemplary ferrite loaded loop antenna 10 with the dimensions and/or ratios described above for use as a high frequency (HF) antenna, it should be appreciated that by implementing the principles described herein, the exemplary antenna 10 may be configured for other frequency ranges. Therefore, modifications of the dimensions and/or ratios shown herein are within the purview of one of ordinary skill in the art, and may be made without departing from the spirit and scope of this disclosure.

FIG. 2 is a cross-sectional view of an exemplary antenna across the feed, showing the details of the feed structure 20 layout. The differing permeabilities of the ferrite core 12 and center element 17 are shown as $\mu_1$ and $\mu_2$, respectively. The feed structure 20 is composed of electrical connections 22 to the antenna feed plates 14 at or about the balanced feed 16. The electrical connections 22 are coupled via feed lines 24 to the balun 26. The balun 26 is disposed "behind" the ground plane 19. The feed structure 20 provides a balanced feed 16 of the antenna feed plates 14. It should be noted that while it may be standard practice to place the electrical connections 22 at a center point of the gap of the balanced feed 16, in some embodiments, it may be desirable to place the electrical connections 22 "off-center." Therefore, variations of the feed structure 20 layout may be practiced without departing from the spirit and scope of this disclosure.

Figure 3:
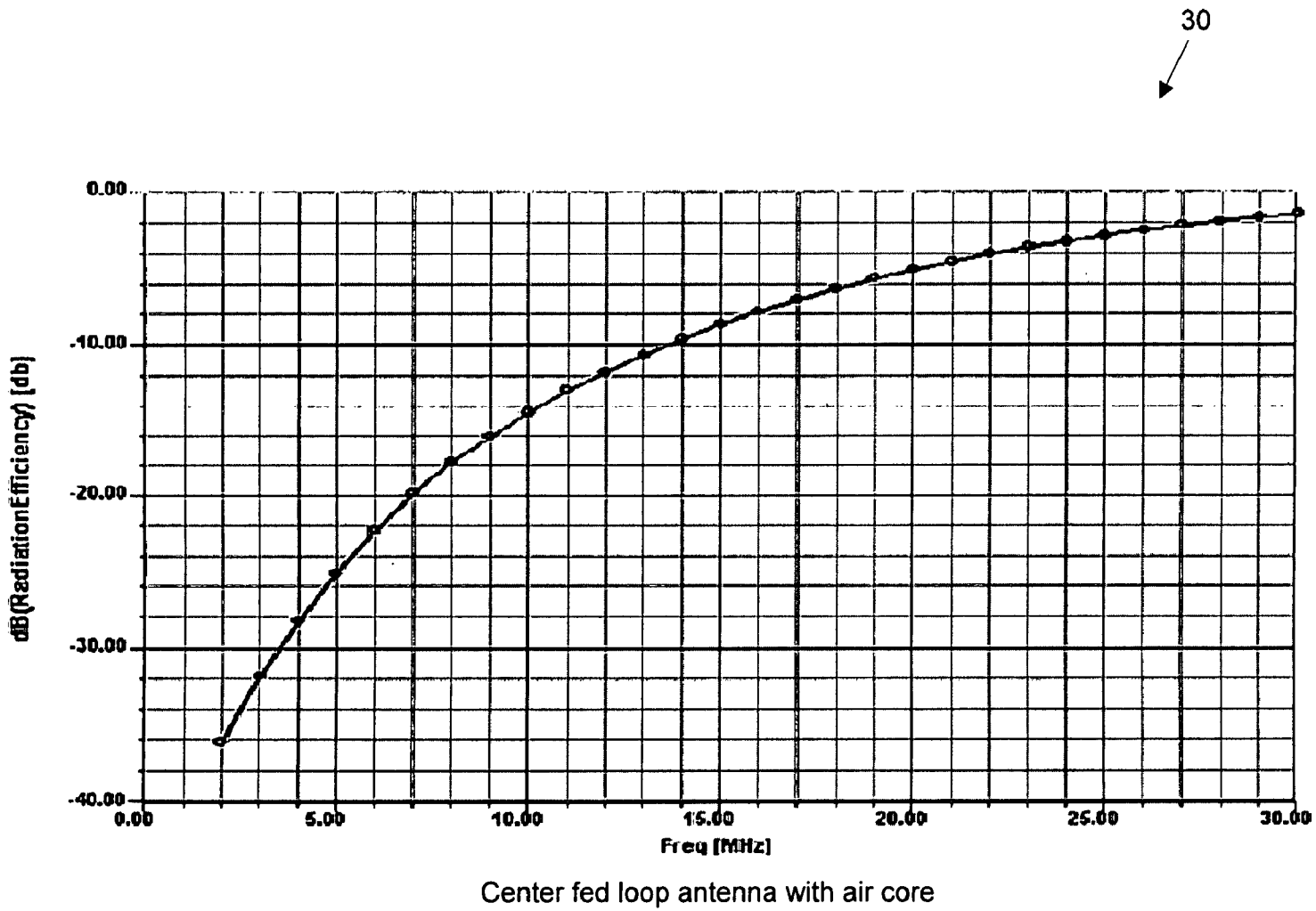
FIG. 3 is a radiation efficiency plot of a related side-fed open loop antenna having comparable dimensions to that of the exemplary antenna of FIG. 1.

FIG. 3 is a radiation efficiency plot 30 of a related side-fed open loop antenna having comparable dimensions to that of the exemplary antenna disclosed herein. The open loop antenna encompasses an air core (not ferrite). The plot 30 shows the radiation efficiency in terms of dB and illustrates the "smooth" frequency response over a typical HF frequency range (2-30 MHz). However, it is noted that at the lower end of the frequency range (<5 MHz), the efficiency is on the order of −25 dB or less.

Figure 4:
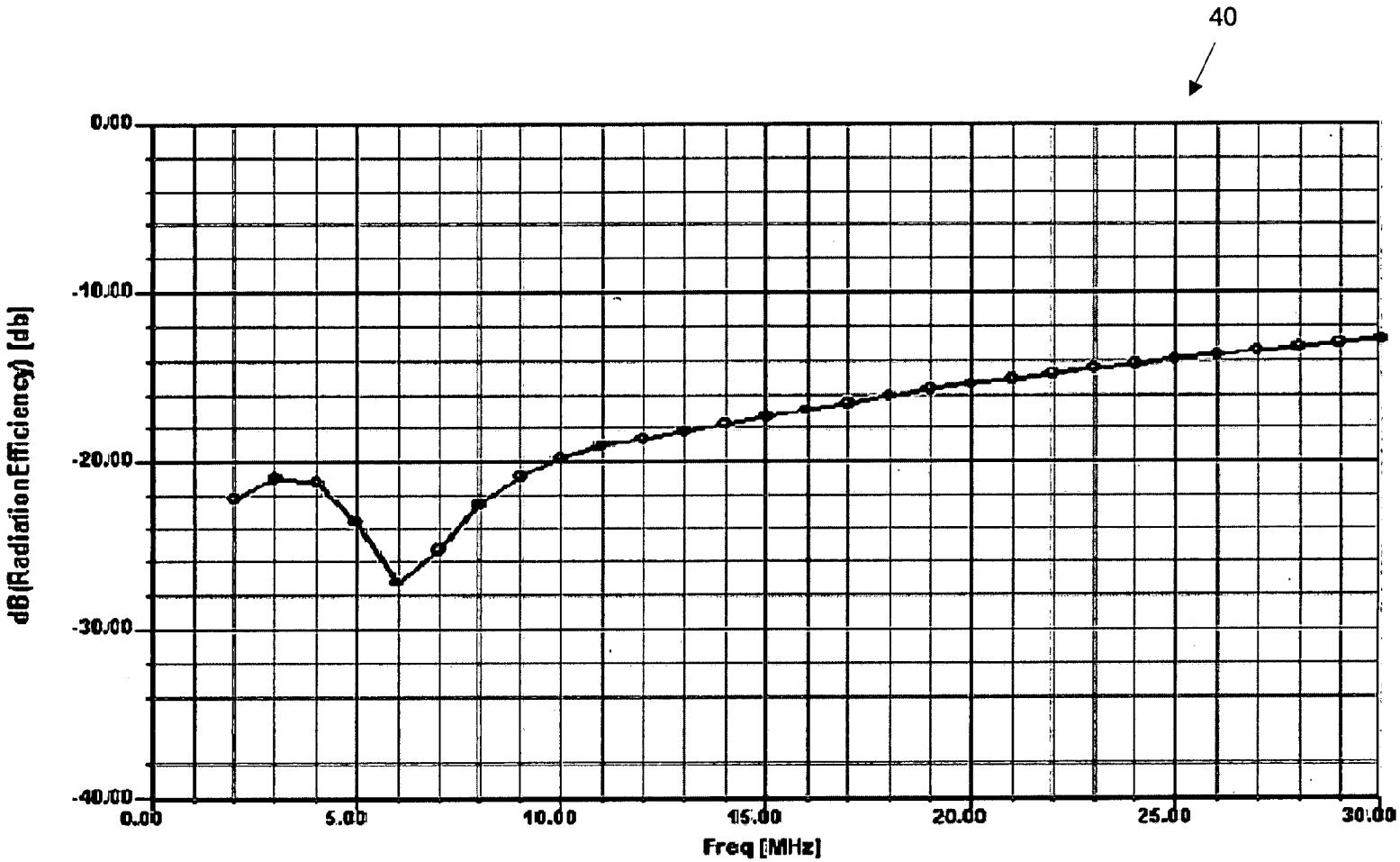
FIG. 4 is a radiation efficiency plot of the side-fed loop antenna of FIG. 3 with a typical ferrite core.

FIG. 4 is a radiation efficiency plot 40 of the side-fed loop antenna of FIG. 3, however, with a ferrite core. Here, it is clearly evident that the addition of ferrite increases the radiation efficiency at the lower end of the frequency range. However, the abrupt dip at the 6 MHz point renders this as an undesirable broadband antenna candidate.

Figure 5:
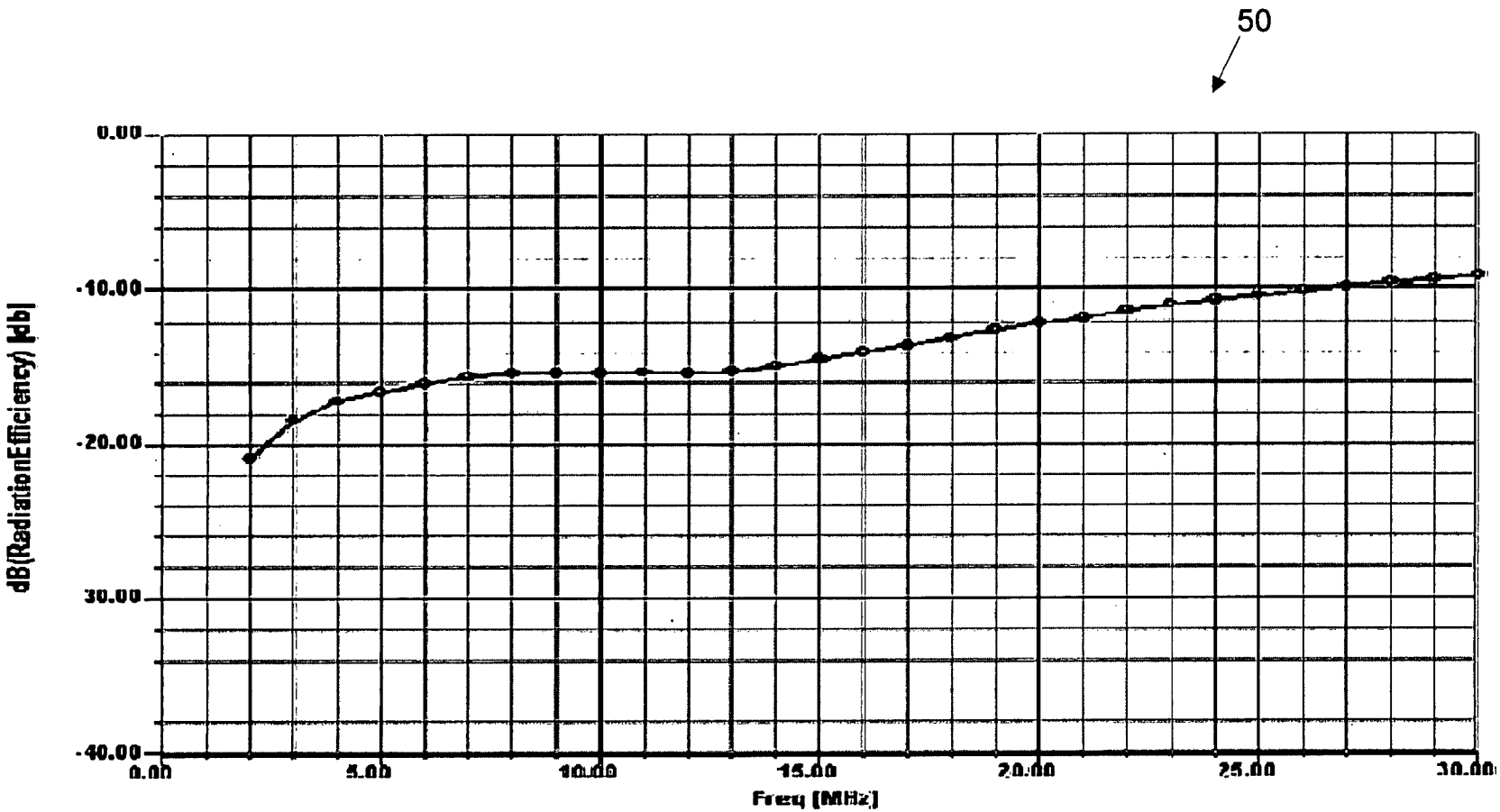
FIG. 5 is a radiation efficiency plot of an exemplary antenna.

FIG. 5 is a radiation efficiency plot 50 of an exemplary antenna. The plot 50 shows the improvement over the related art antenna plots of FIGS. 3-4.

Figure 6:
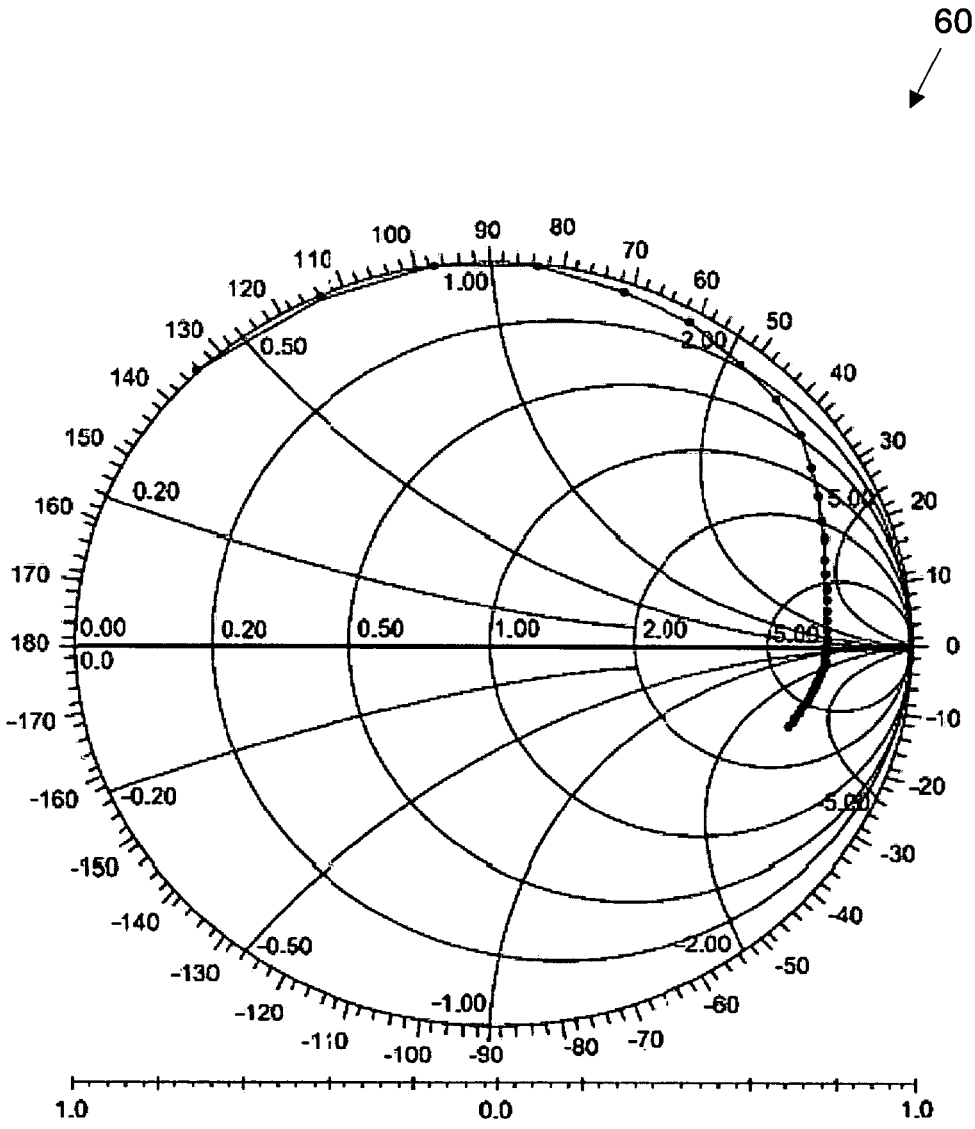
FIG. 6 is a Smith chart showing the impedance profile of an exemplary antenna.

FIG. 6 is a Smith chart 60 showing the measured impedance profile of an exemplary antenna. As can be seen, the impedance is well-behaved over the frequencies of interest.

Figure 7B:
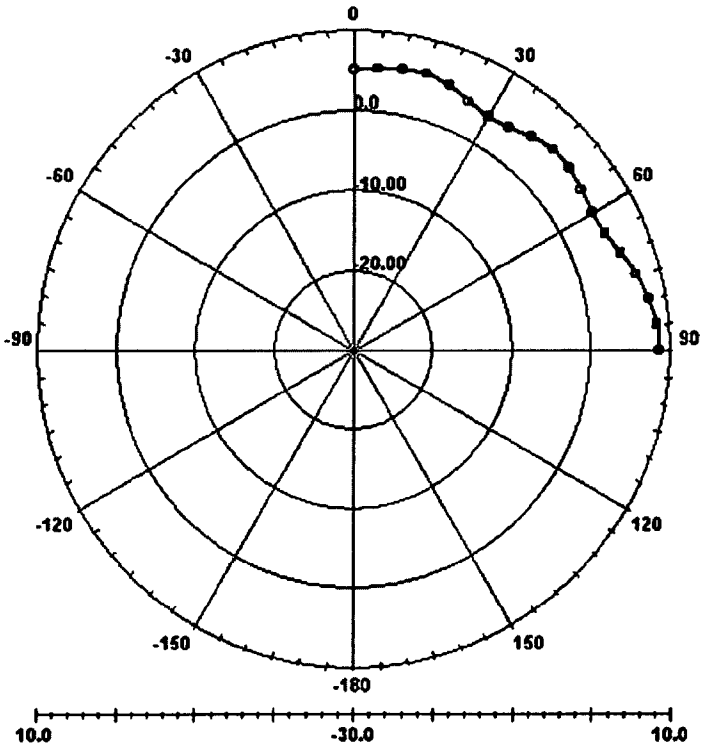
FIGS. 7A-7B are plots showing the radiation pattern for azimuthal and elevation cuts of an exemplary antenna.
Figure 7A:
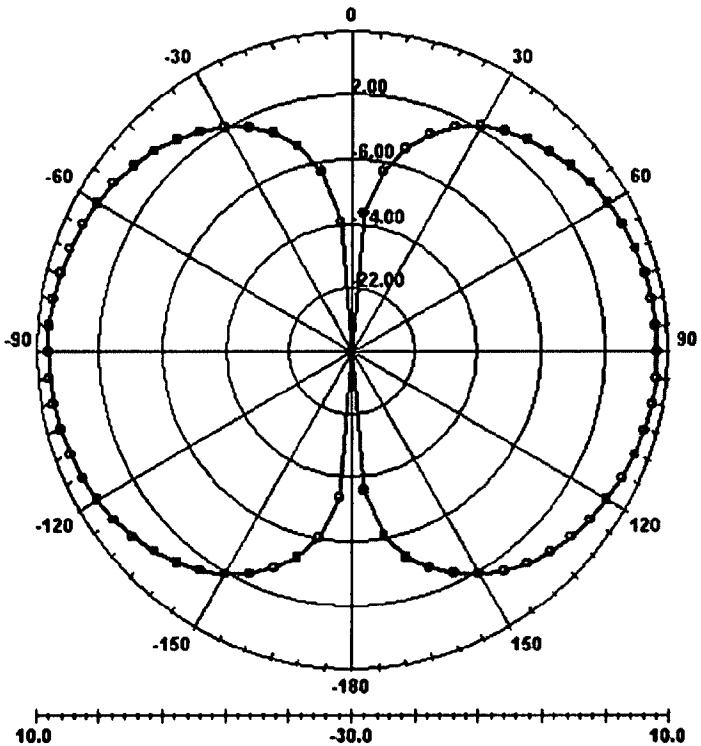

FIGS. 7A-7B are plots showing the radiation pattern for azimuthal and elevation cuts of an exemplary antenna. The symmetry and directivity of the exemplary antenna are shown.

Figure 8:
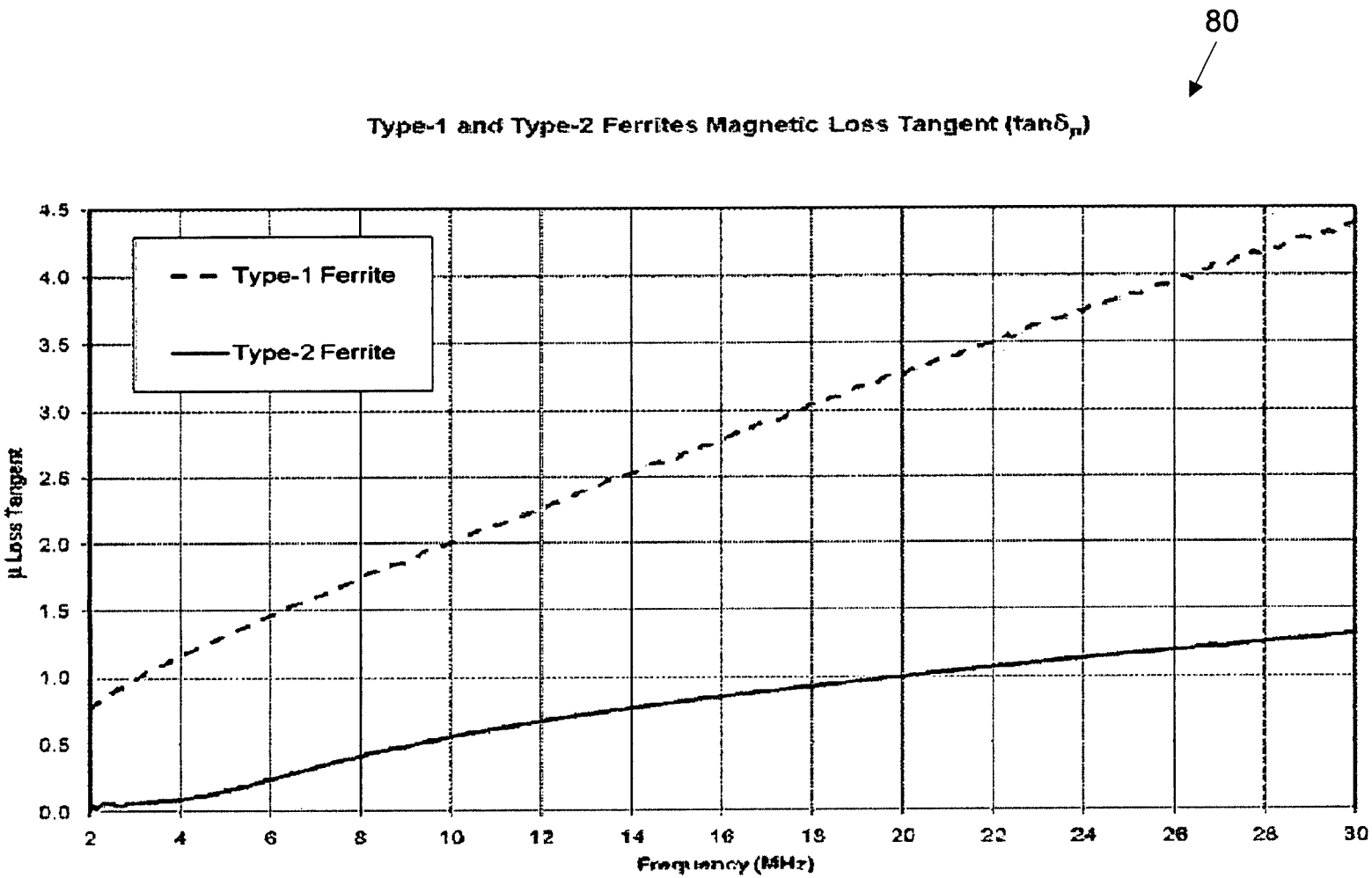
FIG. 8 is a loss tangent plot of two different types of ferrite material.

FIG. 8 is a loss tangent plot 80 of two different types of ferrite material. These ferrite materials are categorized as Type-1 (81) and Type-2 (83). These ferrite materials were obtained from Fischer Custom Communications, Inc.

Figure 9:
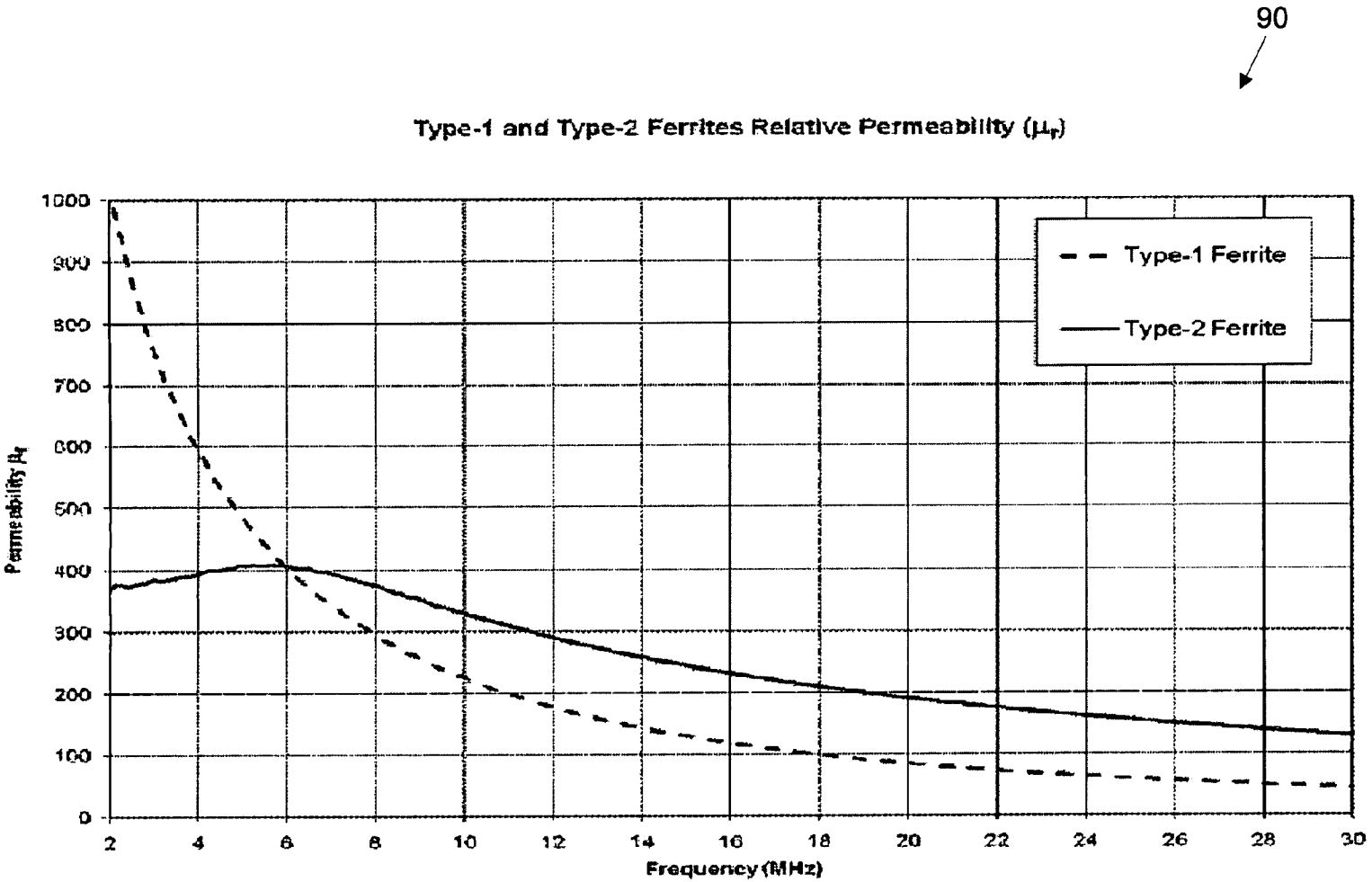
FIG. 9 is a permeability plot of two different types of ferrite material.

FIG. 9 is a relative permeability plot of the different types of ferrite materials shown in FIG. 8. As discussed above, material Type-2 having the better lower frequency response was used in the exemplary antenna.

Based on the disclosure provided herein a ferrite loaded loop antenna having a broadband HF response both for reception and transmission is described. The shape of the antenna enables it to be implemented into a cavity while still demonstrating a desired gain. It should be understood therefore that modifications to the shape of the ferrite core and the center element may be made without departing from this disclosure's spirit and scope. For example, the ferrite core may be non-rectangular in shape or form as well as the center element, or the feed plates. Additionally, multiple feeds made be implemented with multiple baluns, if necessary.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A broadband ferrite-loaded loop antenna, comprising:

a low loss ferrite core having a width-to-height ratio of approximately 24 and a depth-to-height ratio of approximately 6;

an antenna feed plate assembly centered about a long axis of the ferrite core, having a width-to-height ratio of approximately 6 and a width-to-depth ratio of approximately 1;

a balanced feed located at a center of the antenna feed plate assembly, positioned on a radiating side of the antenna;

a low loss center element in the ferrite core, the center element having at least one of a loss tangent and a permeability that is lower than the ferrite core; and a grounding surface coupled to the antenna feed plate assembly, wherein the broadband ferrite-loaded loop antenna operates within a range of approximately 2-30 MHz and has a comparable receiving versus transmitting performance characteristic.

2. The antenna of claim 1, wherein the grounding surface is recessed to enable the antenna to be situated within the recess.

3. The antenna of claim 1, wherein the center element is air.

4. The antenna of claim 1, wherein the center element is Styrofoam.

5. The antenna of claim 1, further comprising a balun disposed at a rear section of the antenna, the balun being under the grounding surface.

6. The antenna of claim 1, wherein the center element has a width-to-depth ratio of approximately 2 and a depth-to-height ratio of approximately 9/4 .

7. The antenna of claim 1, wherein the ferrite core is of a Type-2 material as characterized by Fischer Custom Communications, Inc.

8. A broadband ferrite-loaded loop antenna, comprising:

means for channeling magnetic fields with a low loss tangent, the channeling means having a width-to-height ratio of approximately 24 and a depth-to-height ratio of approximately 6;

means for conducting electrical energy, the conducting means centered about a long axis of the channeling means, and having a width-to-height ratio of approximately 6 and a width-to-depth ratio of approximately 1;

means for transitioning electrical energy, the transitioning means being located at a center of the conducting means, and positioned on a radiating side of the antenna;

means for reducing losses in the channeling means, the reducing losses means having at least one of a loss tangent and a permeability that is lower than the channeling means; and grounding means coupled to the conducting means, wherein the broadband ferrite-loaded loop antenna operates within a range of approximately 2-30 MHz and has a comparable receiving versus transmitting performance characteristic.

9. The antenna of claim 8, wherein the grounding means is recessed to enable the antenna to be situated within the recess.

10. The antenna of claim 8, wherein the reducing losses means has a permeability substantially equivalent to air.

11. The antenna of claim 8, wherein the reducing losses means has a permeability equivalent to that of Styrofoam.

12. The antenna of claim 8, further comprising a balancing means for converting unbalanced electrical energy to balanced electrical energy, the balancing means being disposed at a rear broadside section of the antenna and being under the grounding means.

13. The antenna of claim 8, wherein the reducing losses means has a width-to-depth ratio of approximately 2 and a depth-to-height ratio of approximately 9/4.

14. The antenna of claim 8, wherein the channeling means is equivalent to a Type-2 material as provided by Fischer Custom Communications, Inc.

15. A method for fabricating a broadband ferrite-loaded loop antenna, comprising:

forming a low loss ferrite core having a width-to-height ratio of approximately 24 and a depth-to-height ratio of approximately 6;

attaching an antenna feed plate assembly to the ferrite core about a major axis of the ferrite core, the antenna feed plate assembly centered about a long axis of the ferrite core, having a width-to-height ratio of approximately 6 and a width-to-depth ratio of approximately 1;

forming a balanced feed located at a center of the antenna feed plate assembly, positioned on a radiating side of the antenna;

forming a low loss center element in the ferrite core, the center element having at least one of a loss tangent and a permeability that is lower than the ferrite core; and attaching a grounding surface coupled to the antenna feed plate assembly, wherein the broadband ferrite-loaded loop antenna operates within a range of approximately 2-30 MHz and has a comparable receiving versus transmitting performance characteristic.

16. The method of claim 15, wherein the grounding surface is recessed to enable the antenna to be situated within the recess.

17. The method of claim 15, wherein the center element is formed of Styrofoam.

18. The method of claim 15, further comprising attaching a balun disposed at a rear section of the antenna, the balun being under the grounding surface.

19. The method of claim 15, wherein the center element is formed to have a width-to-depth ratio of approximately 2 and a depth-to-height ratio of approximately 9/4.

20. The method of claim 15, wherein the ferrite core is formed of a material equivalent to a Type-2 material provided by Fischer Custom Communications, Inc.

* * * * *